US006976771B1

(12) United States Patent
Gálvez

(10) Patent No.: US 6,976,771 B1
(45) Date of Patent: Dec. 20, 2005

(54) WORK LIGHT WITH HINGED LENS

(75) Inventor: James M. Gálvez, San Dimas, CA (US)

(73) Assignee: National Electric Manufacturing Corporation, Commerce, CA (US)

( * ) Notice: Subject to any disclaimer, the term of this patent is extended or adjusted under 35 U.S.C. 154(b) by 35 days.

(21) Appl. No.: 10/714,299

(22) Filed: Nov. 13, 2003

Related U.S. Application Data

(63) Continuation-in-part of application No. 29/176,538, filed on Feb. 25, 2003, now Pat. No. Des. 483,508.

(51) Int. Cl.[7] ..... F21V 21/08
(52) U.S. Cl. ..... 362/399; 362/374; 362/486
(58) Field of Search ..... 362/399, 400, 362/374, 375, 376, 378, 486

(56) References Cited

U.S. PATENT DOCUMENTS 5,463,535 A * 10/1995 Vest ..... 362/102

* cited by examiner

*Primary Examiner*—John Anthony Ward
*Assistant Examiner*—Mark Tsidulko
(74) *Attorney, Agent, or Firm*—William W. Haefliger

(57) ABSTRACT

An illumination device confusing, in combination, a housing having a first elongated section and a second elongated section extending endwise relative to the first section, and an elongated lens assembled to the second section and having hinge support at or near one end of the lens to enable jaw-like opening bodily swinging the lens abut a hinge support axis defined by said hinge support, to gain access to elongated illumination bulb means carried by and within by the second elongated section.

12 Claims, 3 Drawing Sheets

WORK LIGHT WITH HINGED LENS

This application is a continuation-in-part of U.S. Design application Ser. No. 29/176,538, filed Feb. 25, 2003 now U.S. Design Pat. No. D,483,508.

BACKGROUND OF THE INVENTION

This invention relates generally to illumination apparatus, and more particularly to an improved and rugged illumination device for use in workplaces, and enabling quick access to a bulb or bulbs, such as a fluorescent bulb.

There is need for devices as referred to, which enable easy and safe endwise removal and replacement of elongated bulbs. There is also need for direct access to such elongated bulbs, along their lengths, to facilitate such removal and replacement.

Further there is need for provision of such direct access, while at the same time retaining an elongated lens to the device, to prevent damage of the lens during such bulb removal and replacement.

SUMMARY OF THE INVENTION

It is a major object of the invention to provide an improved illumination device meeting the above described needs. Basically, the preferred embodiment of a device meeting such needs includes:

a) a housing having a first elongated section and a second elongated section extending endwise relative to the first section, b) and an elongated lens assembled to the second section and having hinge support at or near one end of the lens to enable jaw-like opening bodily swinging the lens about a hinge support axis defined by said hinge support, to gain access to elongated illumination bulb means carried by and within by the second elongated section.

As will appear, the lens may preferably have U-shaped curvature in planes along the lens length an in planes normal to the elongation direction of the lens.

Another object is to provide the housing second section with at least one L-shaped arm extending, with curvature matching lens curvature, toward said hinge support, proximate said one end of the lens.

A further object is to locate the direction of elongation of the second section to be angled at between 3° and 15° relative to the direction of elongation of the first section, said hinge support protectively located at or near an obtuse angle defined by said first and second section directions of elongation.

A feature of the invention adding to compactness and protection, is to provide a plane defined by the two directions of elongation, and which bisects the lens, lengthwise thereof. The lens may advantageously have U-shaped curvature along its length for wide light distribution, the lens remaining intersected by the defined plane as to the lens swings with jaw-like motion, about the hinge support. In this regard, the second section preferably includes a second L-shaped arm which extends with curvature matching lens curvature, toward said hinge support, proximate said one end of the lens, whereby said one end of the lens is protectively subtended by both of said second section L-shaped arms.

These and other objects and advantages of the invention, as well as the details of an illustrative embodiment, will be more fully understood from the following specification and drawings, in which:

DRAWING DESCRIPTION

DETAILED DESCRIPTION

Figure 1:
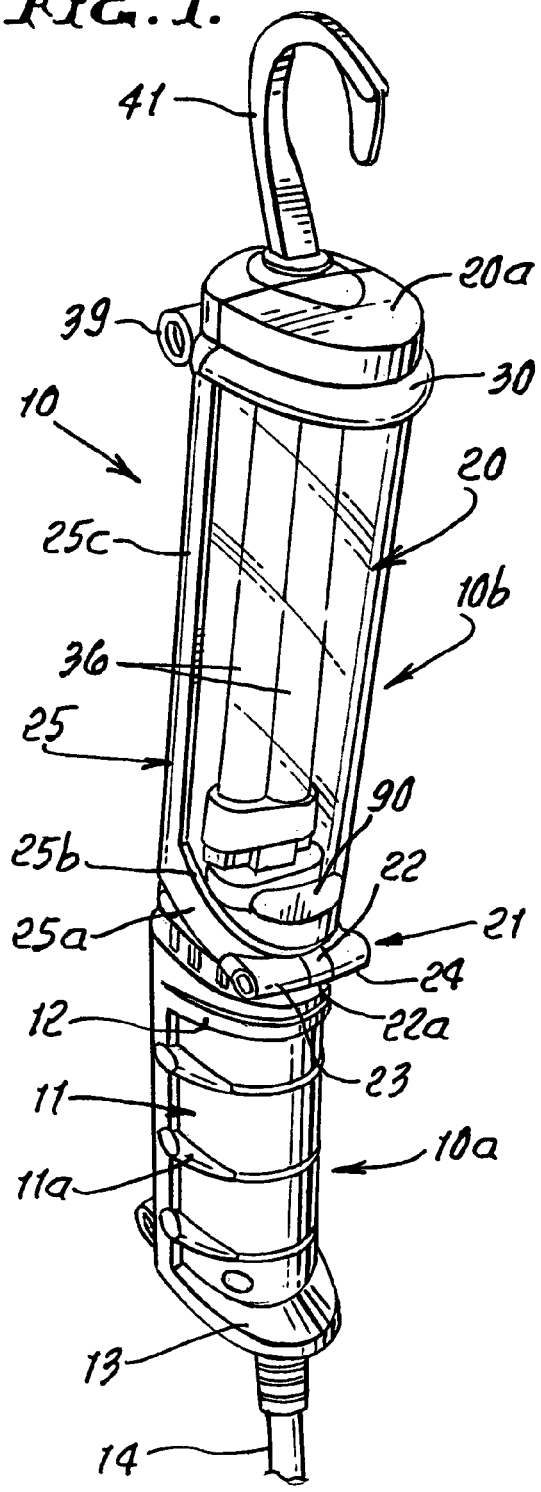
FIG. 1 is a perspective view showing a preferred illumination device.

In the drawings, and as shown, illumination device 10 includes two sections 10*a* and 10*b*. Section 10*a* is lengthwise elongated and has an inwardly sunk, outwardly convex, elongated hand grip surface portion 11 between end flanges 12 and 13. Arcuate protuberances 11*a* project outwardly from 11, and are spaced lengthwise of 10*a* to provide finger grippable sub-surfaces. An electrical cord 14 extends to the end of section 10*a*, to supply electrical current to ballast circuitry housed within 10*a*. An alternative electrical plug is shown at 14*a*.

Section 10*b* of the device 10 is elongated and extends endwise relative to section 10*a*, the directions of elongation of the sections 10*a* and 10*b* respectively indicated by arrows 15*a* and 15*b*. Arrow 15*b* is canted relative to arrow 15*a*, and at angle $\alpha$, where $\alpha$ is between 5° and 15°, enhancing illumination utility of the device, as in difficult to access work spaces.

The drawings also show an elongated lens 20 assembled to the second section 10*b*, and in such a way as to have hinge support at 21, proximate one end of the elongated lens. Note the lens carrier 22 projecting away from the lens, and having a smooth convex surface at 22*a*. Carrier fits between two like laterally projecting supports 23 and 24 respectively located on the forwardly jutting portions 25*a* and 26*a* of two L-shaped arms 25 and 26. Portions 25*a* and 26*a* have curvature closely matching lens curvature. Those arms have edge portions 25*b* and 25*c*, and 26*b* and 26*c* bounding the lens 20 at spaced locations along its length, and along the lower extent of its U-shaped configuration, as shown. As the lens is pivoted away from arms 25 and 26 about the axis of the hinged support 21, its edge portions move away form the protective L-shaped arms. The closed lens is protected from impact with other objects or surfaces, by U-shaped bumper 30 extending about the U-shaped upper end extent of the lens, and by the sidewardly jutting arm portions 25*a* and 26*a* and structure 23 and 24. Protective arms 25 and 26 may be considered as parts of the upper section 10*b*. An identification latch is applied, at 90.

Arms 25 and 26 are also curved, along their length, to extend at 25*d* and 26*d* to extend at the rear side of the lens, and protect the elongated fluorescent bulb or bulbs 36 within the interior of 10*b*, and facing the lens. When the lens is pivoted forwardly, and clockwise in FIG. 4, to give access to the interior of 10*b*, from the top right, the bulb or bulbs can be easily removed and replaced, without complete removal of the lens. The lens may thereafter be easily closed back into FIG. 4 position, fitting to protective arms 25 and 26.

Figure 3:
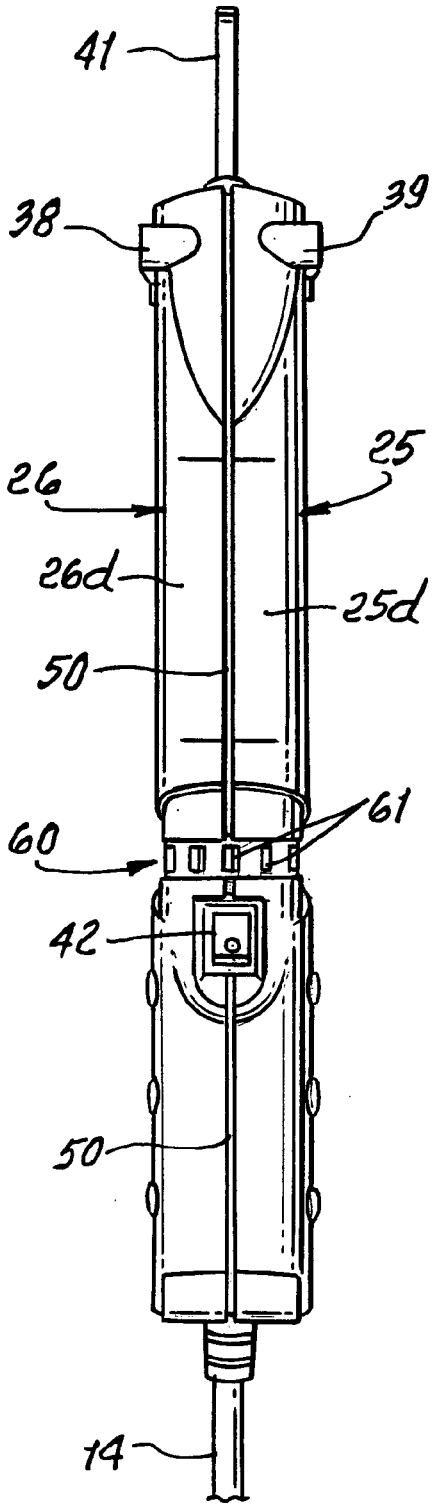
FIG. 3 is an elevation view showing the rear side of the FIG. 1 device.
Figure 4:
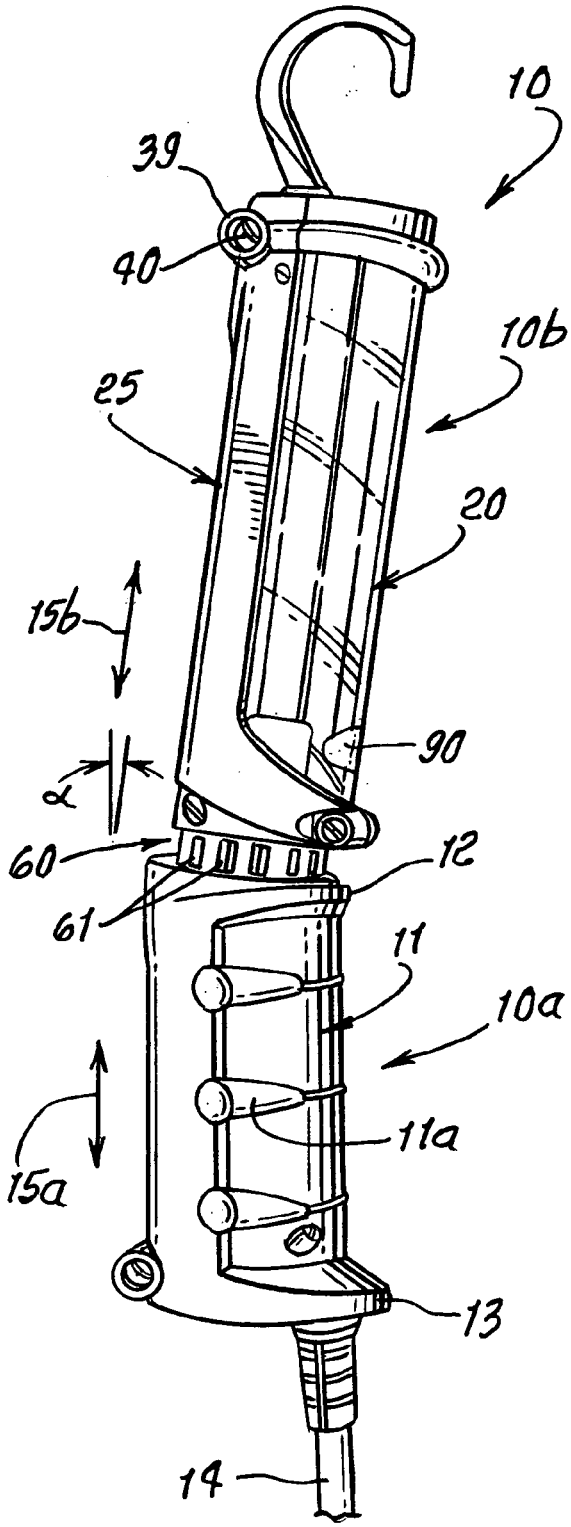
FIG. 4 is a left side elevation view of the FIG. 1 device.
Figure 5:
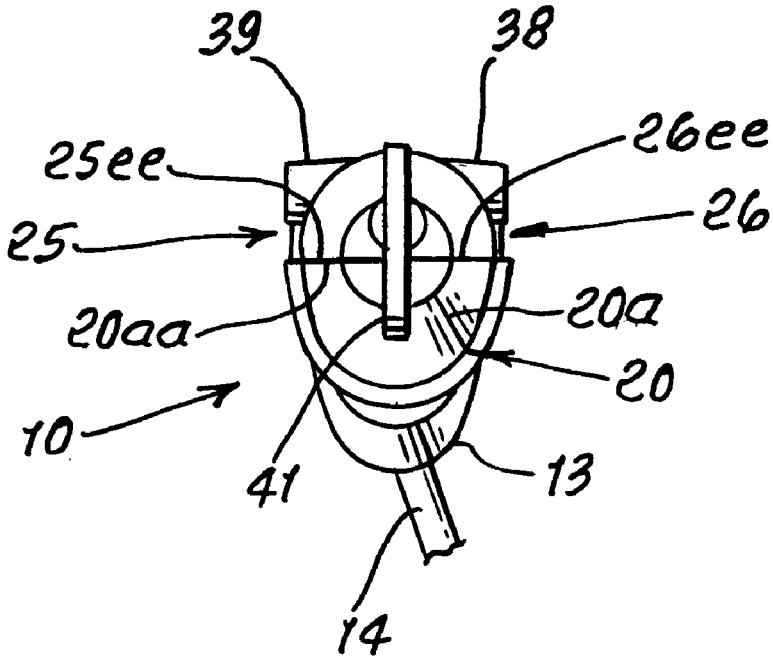
FIG. 5 is a top plan view of the FIG. 1 device.
Figure 6:
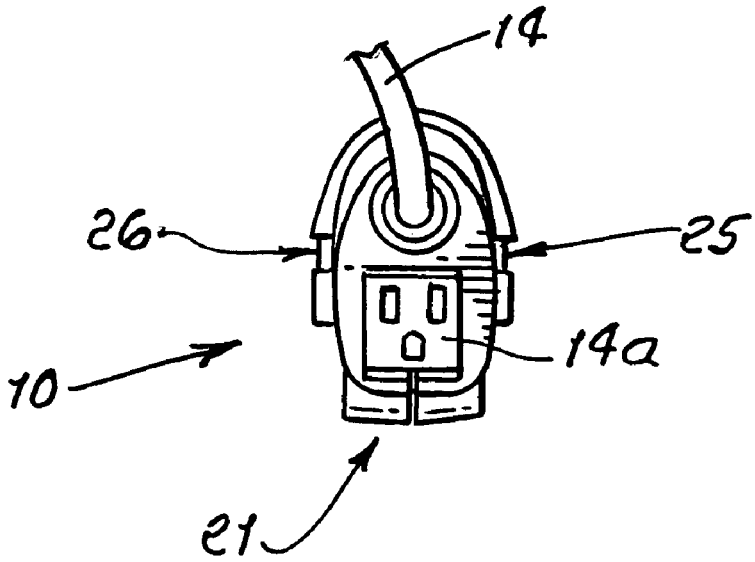
FIG. 6 is a bottom plan view of the FIG. 1 device.

The two arms 25 and 26 may be held in FIGS. 3 and 4 position, by a fastener 40 inserted through aligned retainers 38 and 39 integral with the upper extents of the arms, and in or close to the plane of curved bumper 30. The top 20*a* of the lens has a transverse edge 20*aa* which meets transverse edges 25*ee* and 26*ee* of the tops 25*e* and 26*e* of the arms. See FIG. 5.

The obtuse interior angle formed by and between the two sections 10*a* and 10*b*, serves to protect the hinging zone between the sections, as in case of dropping of the device.

An ON-OFF switch is seen at 42; and a device support or hinging hook 41 protrudes from the end of upper section 10*b*, formed by upper ends of arms 52 and 26.

Figure 2:
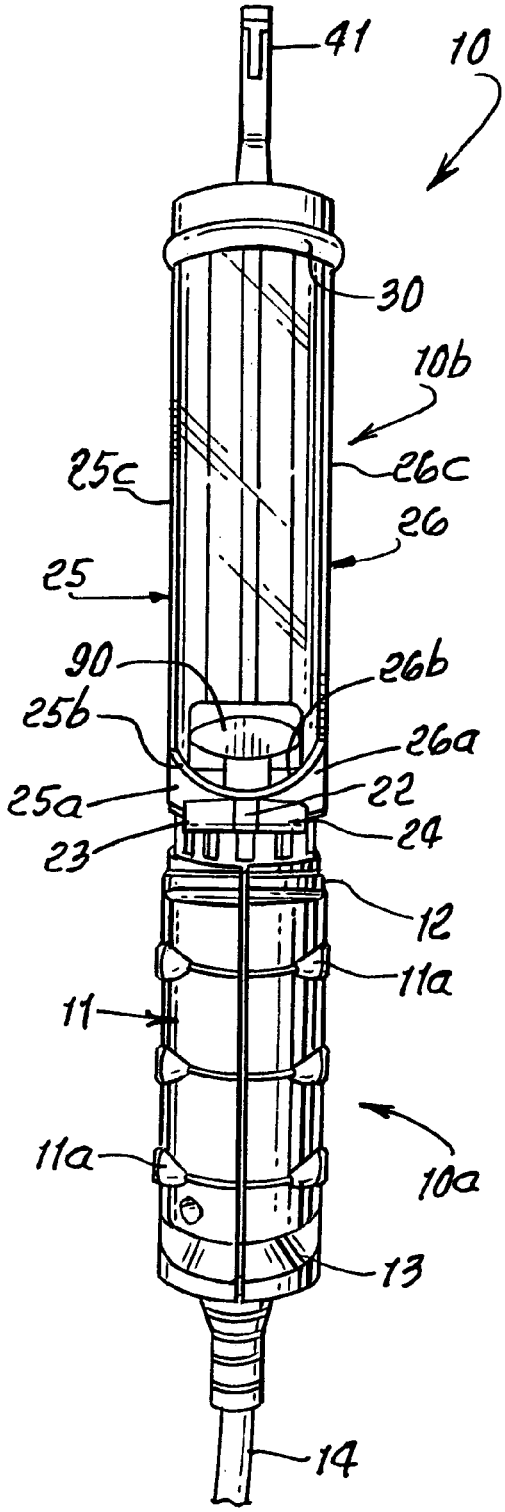
FIG. 2 is an elevation view showing the front side of the FIG. 1 device.

The relatively angled direction of elongation, at the axes of sections 10*a* and 10*b*, define a plane 50 which bisects the lens, lengthwise thereof. The lens has U-shaped curvature along its length, which remains intersected by the plane, as the lens swings with jaw-like movement about said hinge support. That plane 50 also bisects the lens hinged support. See FIG. 2.

A cylindrical connection 60 extends between and supports sections 10*a* and 10*b*. It has detent ribs 61 spaced about its surface, to engage a holder for rotatably supporting auxiliary equipment, with adjustable detent action auxiliary equipment. Connection 60 has reduced and exposed diameter relative to sections 10*a* and 10*b*, whereby such rotatable auxiliary equipment is retained endwise between 10*a* and 10*b*, in adjustably rotated position.

The following claims are intended to cover the design structure as shown in the drawings, and equivalents thereof.

I claim:

1. An illumination device comprising, in combination, a) a housing having a first elongated section, and a second elongated section extending generally endwise relative to the first section, b) and an elongated lens assembled to the second section and having hinge support at or near one end of the lens to enable jaw-like opening bodily swinging of the lens about a hinge support axis defined by said hinge support, to gain access to elongated illumination bulb means carried by and within by the second elongated section, c) the second section including at least one L-shaped arm extending, with curvature substantially matching lens curvature toward said hinge support, proximate said one end of the lens.

2. An illumination device comprising, in combination, a) a housing having a first elongated section, and a second elongated section extending generally endwise relative to the first section, b) and an elongated lens assembled to the second section and having hinge support at or near one end of the lens to enable jaw-like opening bodily swinging of the lens about a hinge support axis defined by said hinge support, to gain access to elongated illumination bulb means carried by and within by the second elongated section, c) the lens having U-shaped curvature in planes along the lens length and in planes normal to the elongation direction of the lens, d) and wherein the second section includes at least one L-shaped arm extending, with curvature substantially matching lens curvature, toward said hinge support, proximate said one end of the lens.

3. The device of claim 2 wherein the direction of elongation of the second section is angled at between 3° and 15° relative to the direction of elongation of the first section, said hinge support protectively located at or near an obtuse angle defined by said first and second section direction of elongation.

4. The combination of claim 3 wherein said relatively angled directions of elongation define a plane which bisects said lens, lengthwise thereof.

5. The combination of claim 4 wherein the lens has U-shaped curvature along its length, which remains intersected by said plane, as the lens swings with jaw-like movement about said hinge support.

6. The combination of claim 4 wherein said plane also bisects said hinge support.

7. The device of claim 2 wherein the L-shaped arm has a terminal assisting in lens support at said hinge support.

8. The combination of claim 2 wherein the second section includes a second L-shaped arm which extends with curvature matching lens curvature, toward said hinge support, proximate said one end of the lens, whereby said one end of the lens is protectively subtended by said second section L-shaped arm.

9. An illumination device comprising, in combination, a) a housing having a first elongated section, and a second elongated section extending generally endwise relative to the first section, b) and an elongated lens assembled to the second section and having hinge support at or near one end of the lens to enable law-like opening bodily swinging of the lens about a hinge support axis defined by said hinge support, to gain access to elongated illumination bulb means carried by and within by the second elongated section, c) and including a hanging support hook carried by said device at the end of the lens furthest from the hinge support.

10. The device of claim 9 wherein the lens has U-shaped curvature in planes along the lens length and in planes normal to the elongation direction of the lens.

11. The combination of claim 9 including an electrical current supply wire extending to the end of the housing first section, furthest from said hinge support.

12. An illumination device comprising, in combination, a) a housing having a first elongated section, and a second elongated section extending generally endwise relative to the first section, b) and an elongated lens assembled to the second section and having hinge support at or near one end of the lens to enable jaw-like opening bodily swinging of the lens about a hinge support axis defined by said hinge support, to gain access to elongated illumination bulb means carried by and within by the second elongated section, c) and including a substantially cylindrical connection, of reduced and exposed diameter, extending between the two sections, to rotatably and adjustably support auxiliary equipment at a location between the sections.

* * * * *